US010717178B2

(12) United States Patent
Yamamoto et al.

(10) Patent No.: US 10,717,178 B2
(45) Date of Patent: Jul. 21, 2020

(54) FASTENER DRIVING MACHINE

(71) Applicant: MAX CO., LTD., Tokyo (JP)

(72) Inventors: Yuu Yamamoto, Tokyo (JP); Tetsuya Ohno, Tokyo (JP); Yasunori Takahashi, Tokyo (JP); Shuhei Kurita, Tokyo (JP)

(73) Assignee: MAX CO., LTD., Tokyo (JP)

( * ) Notice: Subject to any disclaimer, the term of this patent is extended or adjusted under 35 U.S.C. 154(b) by 493 days.

(21) Appl. No.: 15/286,609

(22) Filed: Oct. 6, 2016

(65) Prior Publication Data

US 2017/0100827 A1 Apr. 13, 2017

(30) Foreign Application Priority Data

Oct. 9, 2015 (JP) ..... 2015-201450

(51) Int. Cl.
*B25C 1/00* (2006.01)
*B25C 1/04* (2006.01)

(52) U.S. Cl.
CPC ..... *B25C 1/008* (2013.01); *B25C 1/04* (2013.01); *B25C 1/043* (2013.01); *B25C 1/047* (2013.01)

(58) Field of Classification Search
CPC ..... B25C 1/008; B25C 1/04; B25C 1/043; B25C 1/047
See application file for complete search history.

(56) References Cited

U.S. PATENT DOCUMENTS 5,441,192 A * 8/1995 Sugita ..... B25C 1/041 173/211
6,123,241 A * 9/2000 Walter ..... B25C 1/08 123/46 SC
2009/0236387 A1* 9/2009 Simonelli ..... B25C 5/1668 227/8
2010/0258607 A1* 10/2010 Lam ..... B25C 1/008 227/8
2011/0198380 A1 8/2011 Kitagawa et al.
2011/0198384 A1 8/2011 Kitagawa et al.
2012/0006877 A1* 1/2012 Lee ..... B25C 1/008 227/2
2012/0104069 A1* 5/2012 Chien ..... B25C 1/008 227/2
2012/0211540 A1* 8/2012 Kondou ..... B25C 1/008 227/140

(Continued)

FOREIGN PATENT DOCUMENTS

DE 11 2013 005 280 T5 8/2015
EP A2-0736360 10/1996

(Continued)

OTHER PUBLICATIONS

Extended European Search Report dated Mar. 17, 2017 in corresponding European patent application 16002156.4 (9 pages).

*Primary Examiner* — Hemant Desai
*Assistant Examiner* — Christopher Robin Kim
(74) *Attorney, Agent, or Firm* — Rothwell, Figg, Ernst & Manbeck, P.C.

(57) ABSTRACT

A fastener driving machine includes an actuator which injects a fastener to a driving target object, a controller which controls an operation of the actuator, and a sensor which detects a physical quantity changed by a contact with the driving target object. The controller controls the actuator based on the physical quantity detected by the sensor.

6 Claims, 15 Drawing Sheets

(56) References Cited

U.S. PATENT DOCUMENTS

| | | | | |
|---|---|---|---|---|
| 2012/0325886 | A1* | 12/2012 | Adachi | B25C 1/06 227/2 |
| 2015/0136829 | A1* | 5/2015 | Howes | B25C 1/008 227/140 |
| 2015/0283690 | A1* | 10/2015 | Welte | B25F 5/00 702/183 |
| 2015/0314432 | A1 | 11/2015 | Yang et al. | |
| 2016/0144495 | A1* | 5/2016 | Raggl | B25C 1/008 29/432 |
| 2017/0110006 | A1* | 4/2017 | Yamamoto | G08C 17/02 |
| 2018/0178361 | A1* | 6/2018 | Kabbes | B25C 1/047 |

FOREIGN PATENT DOCUMENTS

| | | | |
|---|---|---|---|
| JP | H05-57635 | A | 3/1993 |
| JP | H09-239674 | A | 9/1997 |
| JP | 3132330 | B2 | 2/2001 |
| JP | 2010-115775 | A | 5/2010 |
| WO | WO-A1-2015053873 | | 4/2015 |

* cited by examiner 1
7b
7a
W
1H STATE 1
7b
7a
W
2H STATE 1
7b
7a
W
3H STATE

1S STATE

2S STATE

3S STATE

FASTENER DRIVING MACHINE

CROSS-REFERENCE TO RELATED APPLICATION

This application claims priority from Japanese Patent Application No. 2015-201450 filed on Oct. 9, 2015, the entire contents of which are incorporated herein by reference.

FIELD

The present disclosure relates to a fastener driving machine.

BACKGROUND

In order to secure a safety in a driving operation of a fastener, an accidental-ejection preventing mechanism is widely used in the related art in which the fastener is not launched only by a control of pulling a trigger lever, and fastener driving can be performed by pressing a contact arm disposed at the tip of a tool.

However, the fastener driving operation is often performed by pressing the contact arm against a driven member in the state of pulling the trigger lever, and thus the contact arm may contact an unintended portion to operate a fastener driving machine.

For this reason, it is prevented that the contact arm is pressed when the contact arm contacts the unintended portion by taking an action that protrudes the contact arm with a spring having high load, which improves the reliability of preventing an accidental ejection. However, there is a problem that a burden on the operator increases since a usual operation load increases.

JP-A-5-57635 describes a driving tool in which a human body detection sensor including a pyroelectric-type infrared ray sensor, an ultrasonic sensor, a capacitive sensor, or the like is embedded in a lower end surface of a guide plate guiding a lower end of a striker. In the driving tool, when the human body detection sensor detects a human body, the driving of the staple is stopped although a main switch is turned on.

JP-A-9-239674 describes a nailing machine in which a pyroelectric-type infrared ray sensor for detecting infrared ray emitted from a human body is provided in the front side of a nose portion including an injection outlet of a nail, and when it is recognized that the human body is present in a direction of injecting a nail, the striking mechanism is not operated although a trigger and the contact arm are erroneously controlled.

Japanese Patent No. 3132330 describes a nailing machine in which an acceleration sensor is mounted in a mechanism housing as a body of the nailing machine. The nailing machine is configured such that in a case where an acceleration pattern and a moving direction, which is stored in advance, of the nailing machine moving toward a driving target object in an injection direction do not match with an acceleration and a moving direction detected by the acceleration sensor, a nail is not launched although a fastener driving control is performed.

SUMMARY

In the driving operation of the fastener, there is a case where the fastener driving machine is controlled with one hand while the other hand supports the driving target object.

In the fastener driving tool described in JP-A-5-57635 or JP-A-9-239674, in a case where the fastener driving machine is operated while a hand supports the driving target object as above, it is considered that the human body detection sensor detects the hand supporting the driving target object to stop the fastener driving. It is not preferable that the injection is limited even in a case where the hand is brought close to the device.

In the disclosure described in Japanese Patent No. 3132330, the state of an actuation suspending unit is switched into an actuation suspended state and a suspension released state according to the detection value of the acceleration sensor. Specifically, the control, which prevents a nail from launching upward enen if the fastener driving machine is fallen down with the nose portion directed upward, can be performed. However, there are also a case where the fastener driving machine drives a nail to a floor member from above, and a case where a nail is driven from below toward a member, that is, in a ceiling direction. There is also a case where a nail is driven obliquely to the member. Accordingly, it may be difficult to specify the motion of the fastener driving machine only based on an acceleration at the time of pressing the fastener driving machine against the member.

The disclosure has been made in consideration of the above situation, and an object thereof is to provide a nailing machine in which a safety is improved without deteriorating usability.

To solve the above-described problems, the disclosure has the following configuration.

A fastener driving machine includes: an actuator which injects a fastener to a driving target object; a controller which controls an operation of the actuator; and a sensor which detects a physical quantity changed by a contact with the driving target object, wherein the controller controls the actuator based on the physical quantity detected by the sensor.

To solve the above-described problems, the disclosure has the following configuration.

A fastener driving machine includes: an actuator which injects a fastener to a driving target object; a controller which controls an operation of the actuator; and a sensor which detects a physical quantity changed by a contact with the driving target object, wherein the controller includes a notification unit which notifies whether the physical quantity detected by the sensor satisfies a condition for injecting the fastener, or the physical quantity does not satisfy the condition.

In the fastener driving machine, the sensor which detects the physical quantity may be a sensor configured to detect a vibration.

In the fastener driving machine, the sensor which detects the physical quantity may be a sensor configured to detect a deformation amount of the fastener driving machine generated by a contact with the driving target object.

The fastener driving machine may further include a detector which detects movement information on the fastener driving machine, wherein the controller may control the actuator based on the movement information detected by the detector.

The fastener driving machine may further include a contact member configured to be movable according to the contact with the driving target object, wherein the detector may be capable of detecting all or some of a movement distance, a movement speed, or a moving time of the contact member.

In the fastener driving machine, the sensor may be provided in the contact member or a member interlinked with the contact member.

In the fastener driving machine, the controller may decide a operation force of the actuator based on the physical quantity detected by the sensor.

The fastener driving machine may further includes a reaction reducing mechanism which reduces a reaction generated in the fastener driving machine when the actuator is driven, wherein the controller may control an operation of the reaction reducing mechanism based on the physical quantity detected by the sensor.

The fastener driving machine according to the disclosure can detect the physical quantity of the driving target object through the contact, and can control the operation of the actuator based on the detection result. For this reason, the actuator can be operated under the condition suitable for a driven member.

The control is performed based on the detection result of the physical quantity of the driving target object. Therefore, for example, in a case where it is determined that the contact target object matches with a unique characteristic of a human body, the injection can be limited regardless of a careless injection motion of a user. Thus, it is possible to improve a device safety.

The disclosure can be configured to detect the physical quantity of the driving target object, and can perform a notification or warning on whether the physical quantity satisfies the injection condition of the fastener through the notification unit emitting a sound or light.

Since it can be distinguished whether the contact target object is proper, it is possible to improve the device safety.

The disclosure can be configured to detect the vibration or the deformation generated by a direct contact, and particularly, information on the hardness or the elasticity of the driving target object can be obtained accurately and instantly. In a case where, by using the information, it can be determined, for example, whether the driving target object is a relatively soft member and has a thin thickness, the output at the time of injection is suppressed to drive the fastener with a weak force so that a control to prevent a penetration can be performed. In the fastener driving machine in which wood is assumed as the driving target object, for example, in a case where the fastener is driven to the driving target object, which has a hardness exceeding a specification, such as steel or concrete, the injection can be limited so as to suppress a rebound and the like of the fastener.

Since the determination is performed based on the changing of the vibration or the deformation at the time of contact, it can be detected whether the contact with the driven member occurs or not although the contact arm is not stroked like the existing fastener driving machine. Accordingly, the safety mechanism can be configured without using the contact arm, and thus high pressing force for stroking the contact arm is not required so that the burden on the operator can be reduced.

The disclosure can be configured to detect the movement information of the fastener driving machine at the time of contacting with the driven member, and can obtain the movement information such as speed and acceleration at the time of contact. In this manner, it can be considered that the contact of the fastener driving machine with a member is affected by the detected physical quantity.

For example, the case of slamming strongly can be distinguished from pressing with weak force, and thus, the character of the driven member can be determined accurately without being affected by the contacting method.

The disclosure can be configured to detect the movement information of the fastener driving machine at the time of contacting with the driven member by the contact member configured to be movable according to the contact with the driving target object, and thus the movement information such as speed and acceleration at the time of contact can be obtained more accurately.

In the disclosure, the sensor detecting the physical quantity is disposed around the contact member, and thus the physical quantity changing at the time of contact can be detected with good sensitivity.

The disclosure is configured to determine the operation force of the actuator based on the detected physical quantity. Therefore, in a case where the fastener driving machine is used on a board such as a wall plate and a floor plate, it is possible to control the operation force, for example, to limit the injection with respect to a portion without a base material.

The fastener driving machine, which includes a reaction absorption mechanism absorbing the reaction generated in a direction of separating the fastener driving machine from the object at the time of driving, determines the hardness of the driven member. Therefore, it is possible to control the motion of the reaction absorption mechanism according to the predicted reaction of the driving.

DETAILED DESCRIPTION

An embodiment of a nailing machine 1 formed as a fastener driving machine for a nail as a kind of fastener will be described as an embodiment of the disclosure.

Figure 1:
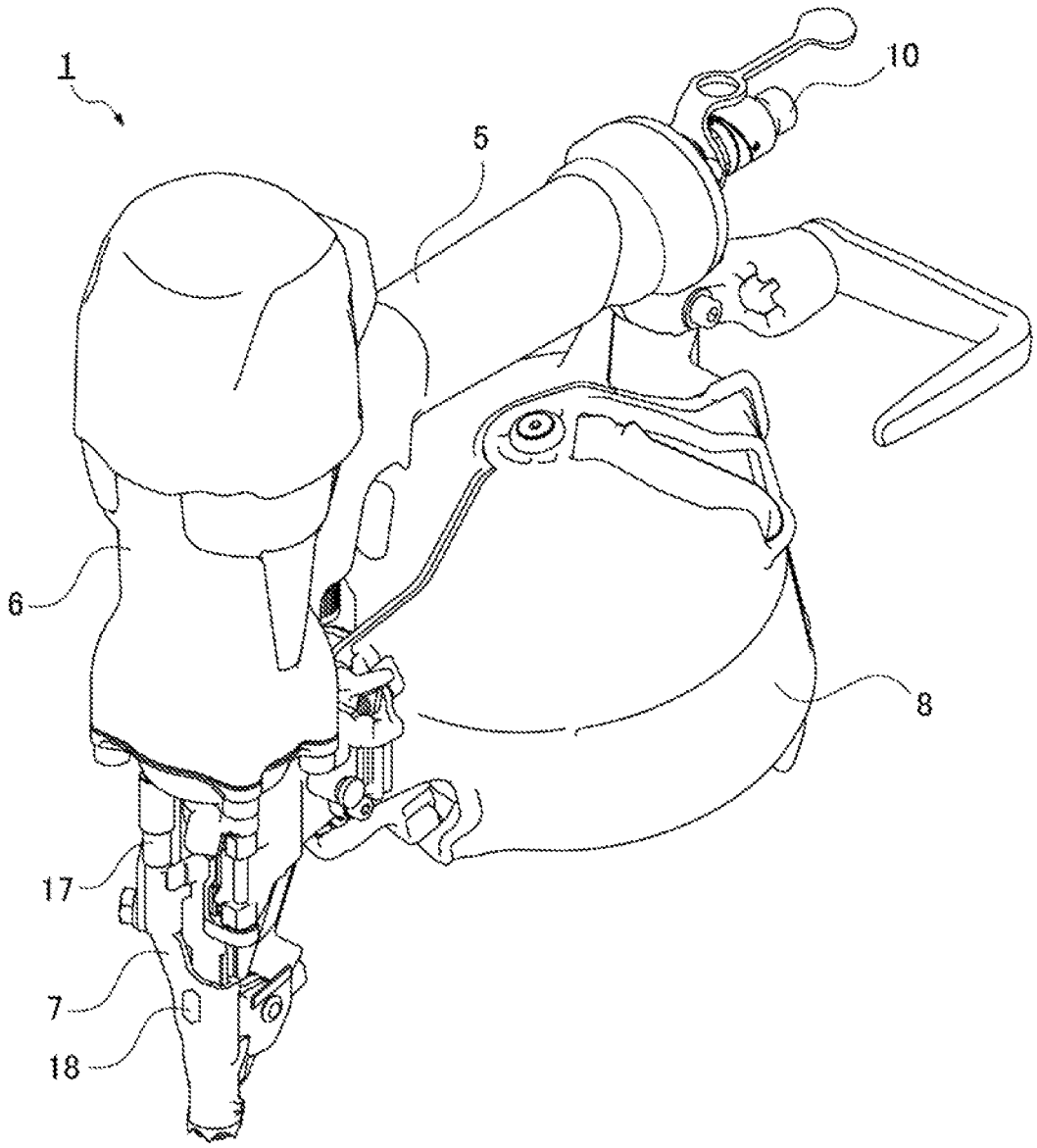
FIG. 1 is a view illustrating an appearance of a nailing machine according to a first embodiment.
Figure 2B:
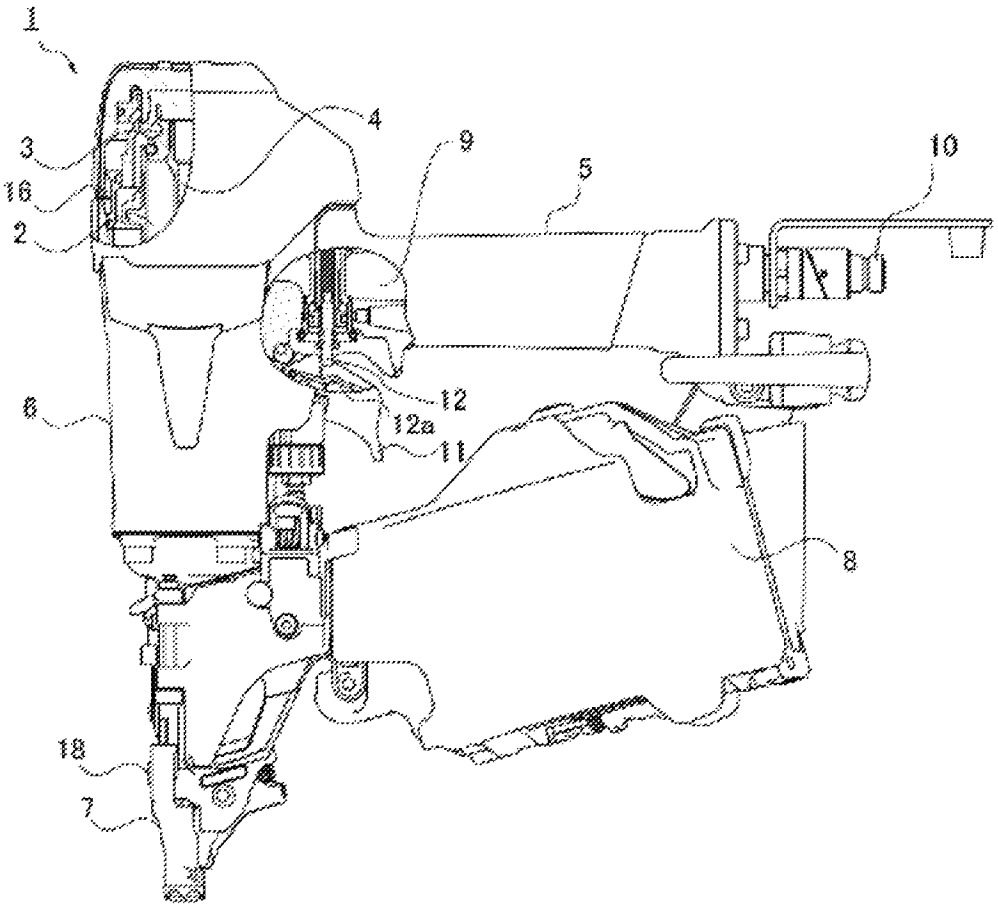
FIGS. 2A and 2B are a front view and a side view illustrating the nailing machine according to the first embodiment.
Figure 2A:
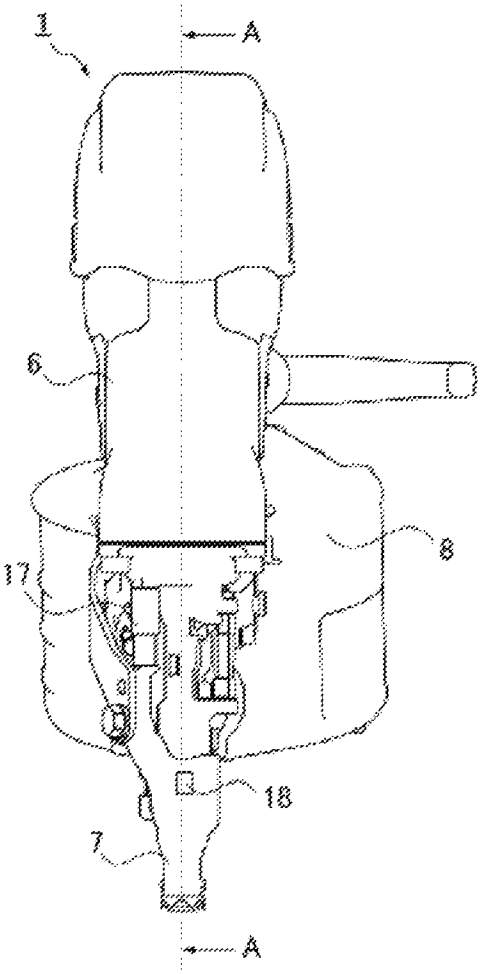

FIG. 1 is a perspective view of a state of the nailing machine 1 when viewed from obliquely above a front surface. FIG. 2A is a front view of the same nailing machine 1, and FIG. 2B is a side view of the same nailing machine 1 (a sectional view taken along line A-A of the partially same front view). The nailing machine 1 illustrated in FIGS. 2A and 2B includes a cylinder 2 and a piston 3 which use compressed air as an actuator, and is configured as a device which injects and drives a nail K loaded at a predetermined position to the object by using a driver 4 fixed to the piston 3 operated by the compressed air.

The actuator which operates the driver 4 is not limited to the above-described pneumatic one, and may be a gas combustion type actuator, an actuator using electromagnetic action, an actuator using a spring force, and the like within the scope and spirit of the disclosure. In this embodiment, a fastener driving device which injects a nail as a fastener is described as an optimal example, but various ones such as a screw, a U-shaped nail (staple), or a special form of fastener may be used.

The cylinder 2 and the piston 3 are contained in a housing 6 positioned on the tip of a handle grip 5 with a grip part. An injection path 14 having a load part for the nail K and a contact arm 7 (7*a*) are provided below the housing 6. The load part for the nail K is configured such that when the nail is injected, a new nail is supplied in order from a magazine 8 instead of the injected nail. The contact arm 7 includes a contact part 7*a* moving along the injection path 14, and an arm part 7*b* associating a movement of the contact part 7*a* with a contact lever 12*a* interlinked with the trigger lever 11.

The inside of the handle grip 5 is configured as an air chamber 9 for storing the compressed air. The compressed air is supplied to the air chamber 9 through an air plug 10 provided in the rear end of the handle grip 5.

The trigger lever 11 is provided around the boundary between the tip of the handle grip 5 and the housing 6. The trigger lever 11 includes the contact lever 12*a* engaged with a trigger valve 12. The trigger valve 12 operates a head valve for supplying the compressed air from the air chamber 9 into the cylinder 2. When the head valve is operated by the motion of the trigger valve 12, a circuit through which the compressed air flows is opened to operate the piston 3 in a direction of injecting a nail. When the trigger lever 11 is returned to return the trigger valve 12, air flows in a direction of returning the piston 3 to an original position so that the driver 4 returns to an initial position.

Figure 3:
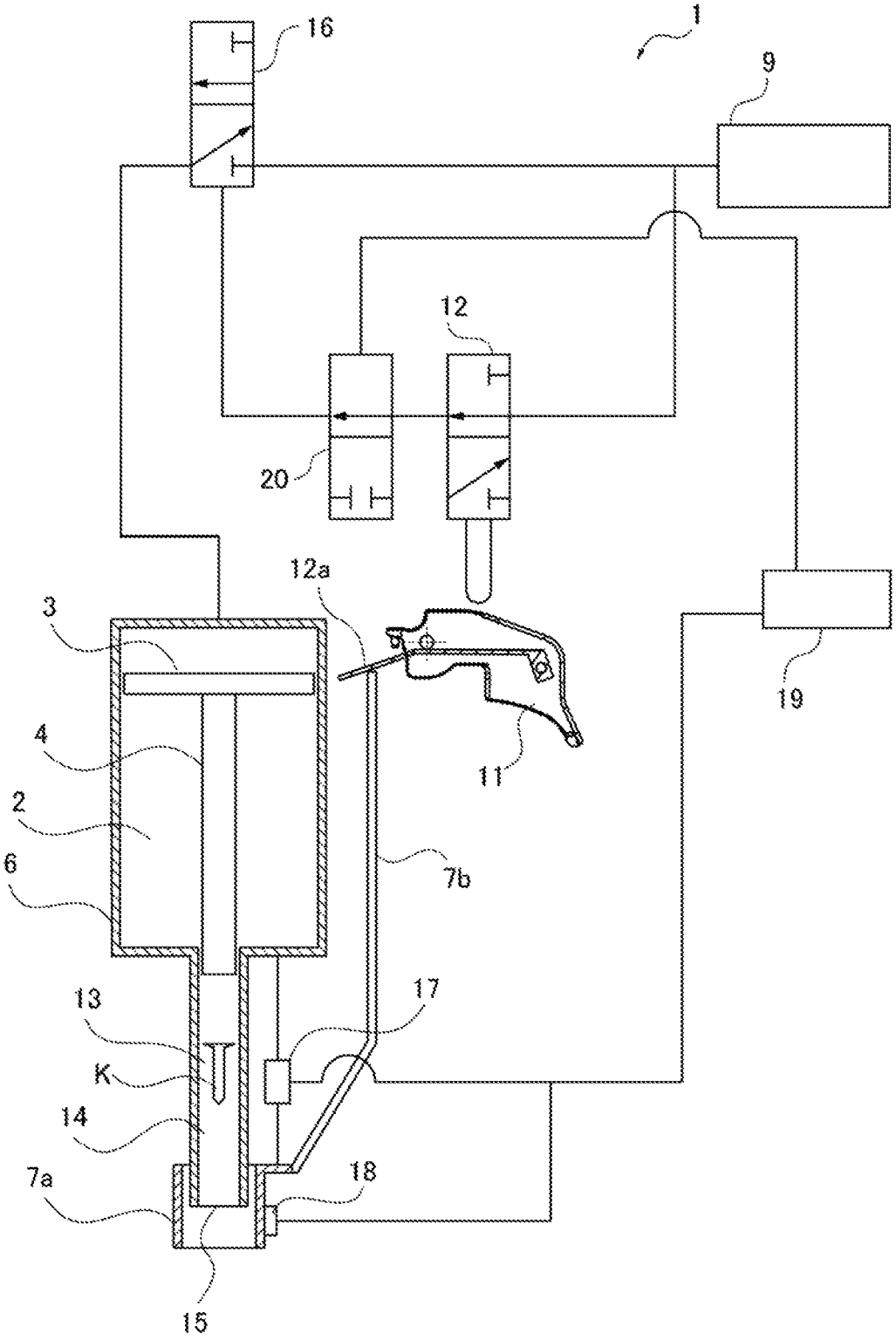
FIG. 3 is an explanatory diagram of an operating mechanism representing a driving-standby state of the nailing machine of according to the first embodiment.

FIG. 3 is a diagram schematically illustrating an operating mechanism focusing on a pneumatic circuit of the nailing machine 1. As described above, the injection path 14 having the load part 13 for the nail K is provided below the housing 6. After the injection of the nail K, the nail K is automatically loaded in the load part 13 from the magazine 8. The nail K loaded in the load part 13 is extruded by the driver 4 passing through the inside of the injection path 14, and injected from an opening (injection outlet 15) provided in an injection part forming the tip portion of the injection path 14.

The driver 4 is operated by the compressed air supplied into the cylinder 2 from the air chamber 9 through a head valve 16. The head valve 16 is a valve configured to be operated by the operation pressure supplied through the trigger valve 12 operated in conjunction with the trigger lever 11, and to be opened and closed by the dissipation of the operation pressure.

The trigger valve 12 is configured to be operated by the contact lever 12*a* operated in conjunction with the trigger lever 11. In this manner, the trigger lever 11 is pulled so that the compressed air of the air chamber 9 operates the driver 4, and a motion of driving the nail K into the object is performed by the hitting force of the driver 4.

The illustrated nailing machine 1 has the contact arm 7 (7*a* and 7*b*) as a safety mechanism. The safety mechanism is a mechanism for preventing a nail from being injected into an unintended object, and there are various kinds of safety mechanisms.

The contact arm 7 used in this embodiment includes the contact part 7*a* protruding from the injection outlet 15. In a case where the contact part 7*a* contacts a driving target object (hereinafter, referred to as an "object") to be pushed up to a predetermined position near the injection outlet 15, the injection of the nail K is mechanically performed by the control of the trigger lever 11.

Hereinafter, the structure of the contact arm 7 mounted in the nailing machine 1 will be described, but the structure of the contact arm functioning as a safety mechanism is not limited to the description.

Figure 4:
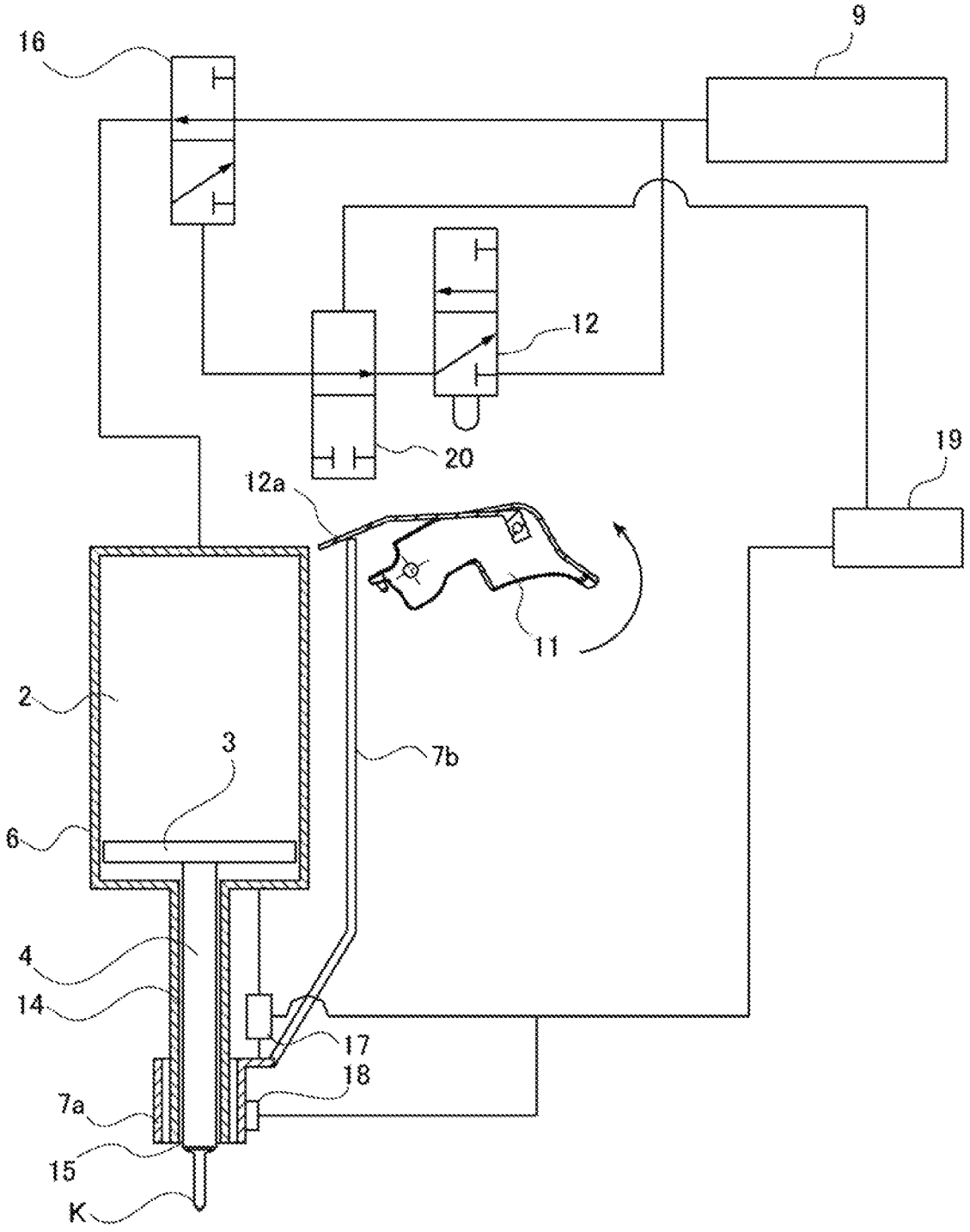
FIG. 4 is an explanatory diagram of an operating mechanism representing a driving state of the nailing machine according to the first embodiment.

The tip of the contact part 7*a* is configured to protrude about 10 mm from the tip of the injection path 14 provided with the injection outlet 15. As illustrated in FIG. 4, when the tip of the contact part 7*a* rises to retreat (rise) to the same level of a position as the tip of the injection path 14, the arm part 7*b* rises in conjunction therewith so as to push up one end of the contact lever 12*a*. At that time, the contact lever 12*a* moves to a position close to the trigger valve 12 but does not contact the trigger valve 12, and thus the injection motion is not performed. In a case where the trigger lever 11 is pulled in addition thereto, the injection motion is performed.

In a case where the trigger lever 11 is pulled in advance, the rotational shaft of the contact lever 12*a* moves to a position close to the trigger valve 12 in conjunction with the control. In this state, when the arm part 7*b* rises to push up the contact lever 12*a*, the trigger valve 12 is controlled to open the circuit so as to perform the injection motion of the nail K.

In this manner, the nailing machine 1 has such specification that the injection motion is performed when the contact part 7*a* is retreated in the state of pulling the trigger lever 11. Therefore, the nail can be consecutively driven in such a manner that the nailing machine 1 is consecutively stroked down to the object with the trigger lever 11 pulled so as to cause the contact part 7*a* to contact the driving target object.

When a fastener driving motion is performed, the nailing machine 1 may rise up from the object due to the reaction thereof. When the trigger lever 11 is in the pulled state at that time, there is a possibility that the nail is injected at a position, which is not originally intended, when the contact part 7*a* lands on the object again. For example, when the contact part 7*a* lands on an air hose supplying the compressed air, a power cord, and the like to inject a nail, an operation may be suspended by a breakage. In the nailing machine 1 according to this embodiment, the following units are provided in order to reduce such a situation as much as possible. Hereinafter, the description will be in detail.

In the nailing machine 1, the contact part 7*a* which is the tip portion of the contact arm 7 is provided with an acceleration sensor 18 as a sensor which detects a vibration acting on the corresponding portion.

The nailing machine 1 allows a nail to be injected when the contact arm 7 contacts the object to be retreated, but in addition, the acceleration sensor 18 detects a value of the vibration generated when the contact arm 7 contacts the object. In this manner, the injection of the nail can be limited based on the vibration property of the object contacting with the contact part 7*a*.

As described above, the contact arm 7 is configured to be retreated when contacting with the object. Therefore, when the object is a properly hard material such as wood, the contact part 7*a* does not sink to the object, and the contact arm 7 is retreated due to the reaction generated by the contact with the object.

On the other hand, when the object is a soft material, a pressing force generated when the contact part 7*a* contacts the object causes the object to sink, and thus the contact arm 7 sinks by a certain amount while the contact arm 7 is retreated by the reaction to the sinking.

In a case where the above-described object is a hard material such as wood, and a case where the object is a soft material such as a human body, the contact part 7*a* receives different momentary impacts from the objects. The momentary impact can be detected as an acceleration by the acceleration sensor 18. Through the difference between the impacts (acceleration) generated in the case of colliding at the same speed, it can be speculated whether the object is hard or soft, for example.

Figure 5:
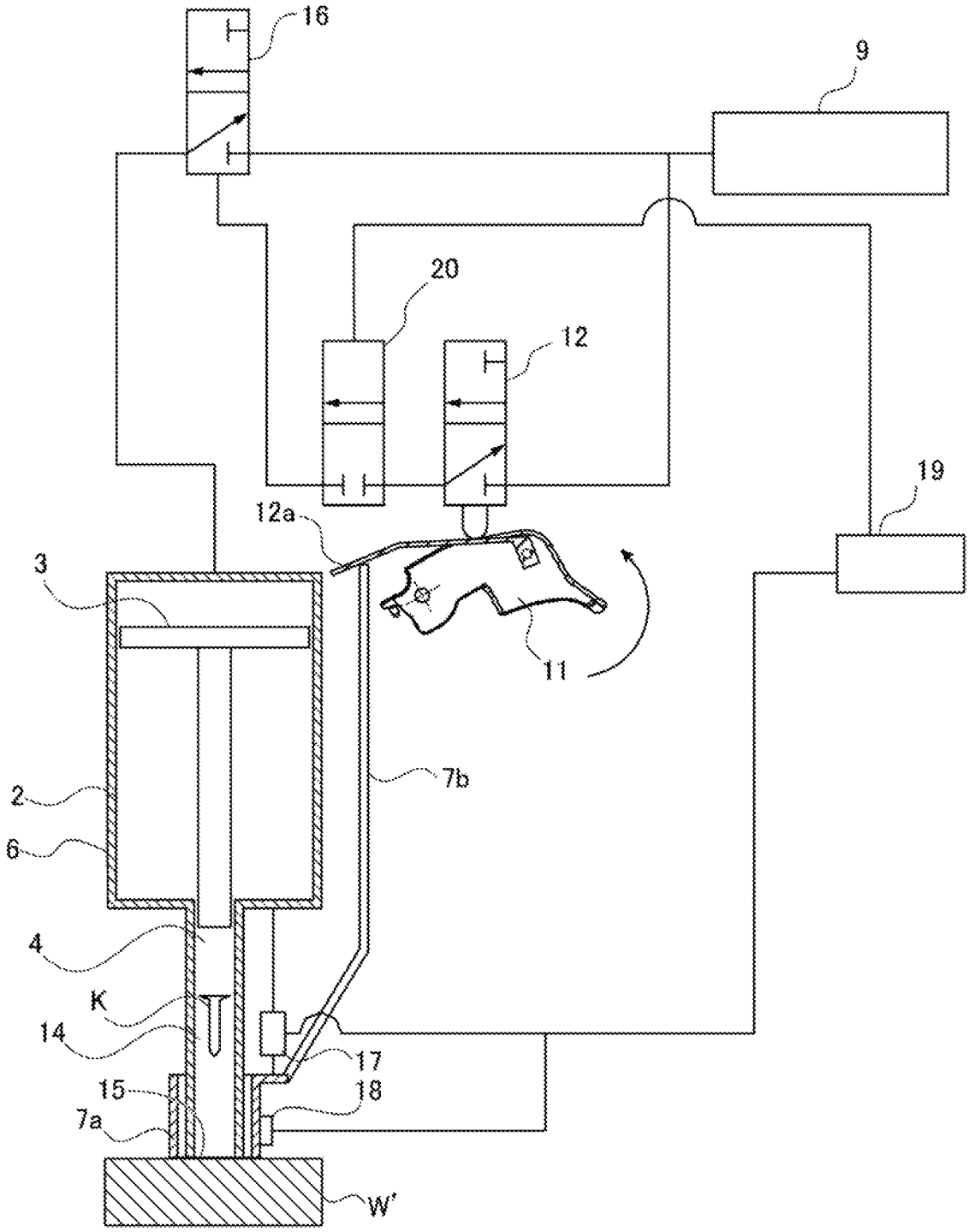
FIG. 5 is an explanatory diagram of an operating mechanism representing the state of limiting the driving of the nailing machine according to the first embodiment.

FIG. 5 illustrates a state where in a case where the contact part 7*a* contacts the soft object W', although the contact lever 12*a* interlinked to the trigger lever 11 operates the trigger valve 12 to open the circuit communicating with the head valve 16 to atmosphere, a closing valve 20 blocks the circuit not to operate the head valve 16. The blocking of the circuit by the closing valve 20 is performed based on the information obtained by the acceleration sensor 18 by a controller 19 as described later.

Figures 6A, 6B, 6C:
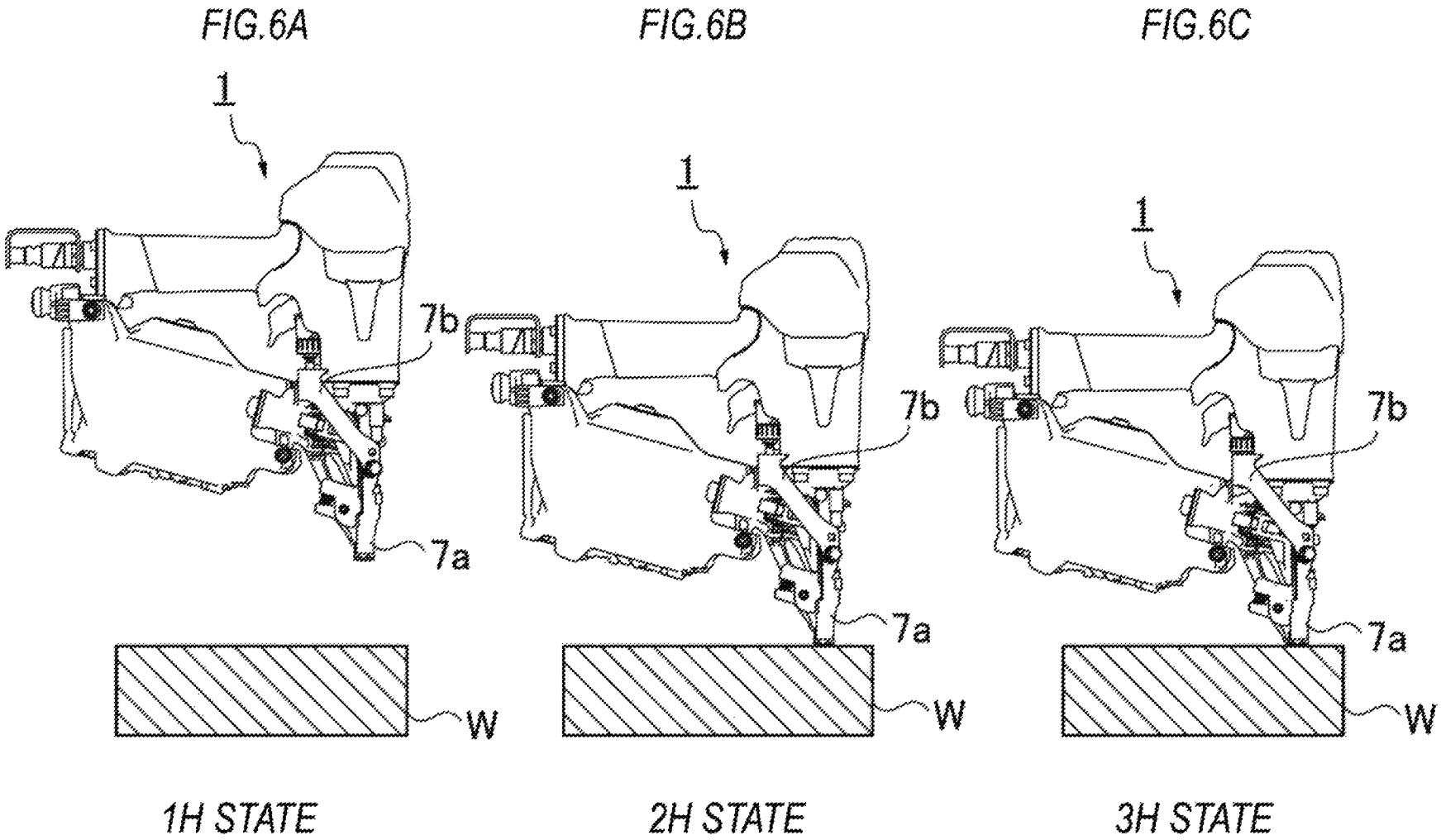
FIGS. 6A to 6C are explanatory diagrams representing from a state where the nailing machine is in contact with a hard object to a state where the injection of a nail can be performed.

FIGS. 6A to 6C are explanatory diagrams representing in order from an aspect where the contact arm 7 (7*a* and 7*b*) contacts the hard object W such as wood to an aspect where the nailing machine 1 becomes injectable. FIG. 6A illustrates a state 1H before the contact arm 7 contacts the object W. FIG. 6B illustrates a state 2H immediately after the contact arm 7 contacts the object W. FIG. 6C illustrates a state 3H where the contact arm 7 contacts the object W, and the contact arm 7 is retreated (rise) to activate a function of the contact lever 12*a* while the contact arm 7 is associated with the contact lever 12*a* interlinked to the trigger lever 11.

Figure 7A:
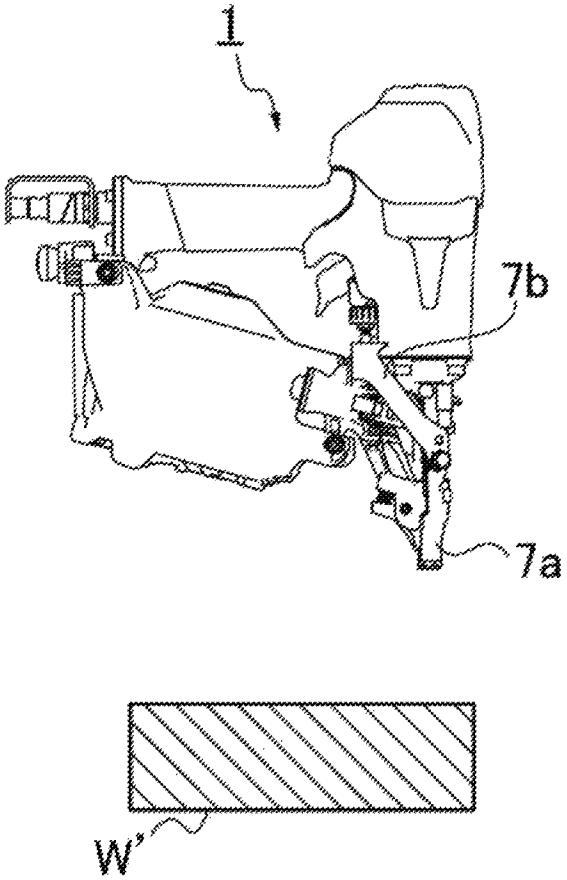
FIGS. 7A to 7C are explanatory diagrams representing from a state where the nailing machine is in contact with a soft object to a state where the injection of a nail can be performed.
Figure 7B:
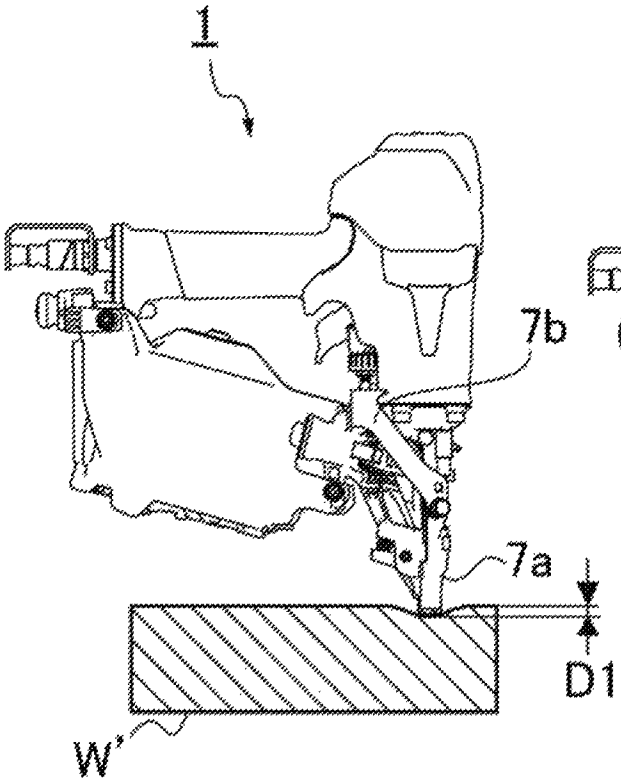
Figure 7C:
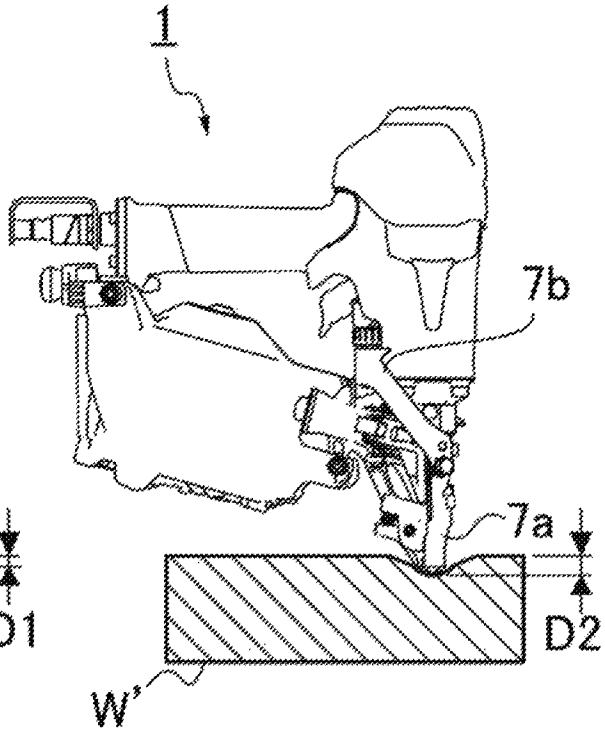

FIGS. 7A to 7C are explanatory diagrams representing, in order, an aspect where the contact arm 7 (7*a* and 7*b*) contacts the soft object W' to rise. FIG. 7A illustrates a state 1S before the contact arm 7 contacts the object W'. FIG. 7B illustrates a state 2S immediately after the contact arm 7 contacts the object W'. FIG. 7C illustrates a state 3S where the contact arm 7 contacts the object W', and the contact arm is retreated (rise) so that the trigger valve 12 is operated.

The contact arm 7 is elastically pushed in an injection direction by a spring or another unit. For this reason, when the tip portion (contact part 7*a*) of the contact arm 7 pushes the object to be risen, it is necessary to push the object with a force exceeding the pressing force of the spring and the like. The force may be set to be larger than the own weight of the nailing machine 1, and when a user does not push the nailing machine 1 with intention of injecting, the contact arm 7 is not risen so that a nail cannot be injected. The object receives the load applied by the user in addition to the own weight of the nailing machine 1, and in the case of the object (for example, hard objects such as wood) with a high load resistance, the shape can be maintained even when receiving the load, but in the case of the object (for example, soft objects) with a low load resistance, deformation occurs under the load.

In each state illustrated in FIGS. 6A to 6C, an object with high load resistance such as wood which is difficult to be deformed is set as the object. In each state illustrated in FIGS. 7A to 7C, a soft material with low load resistance is set as the object, and the material is recessed by an amount D1 by contacting with the contact part 7*a*, and is further recessed by an amount D2 deeper than the amount D1 when the contact part 7*a* is pressed to such extent of being retreated.

Figure 8:
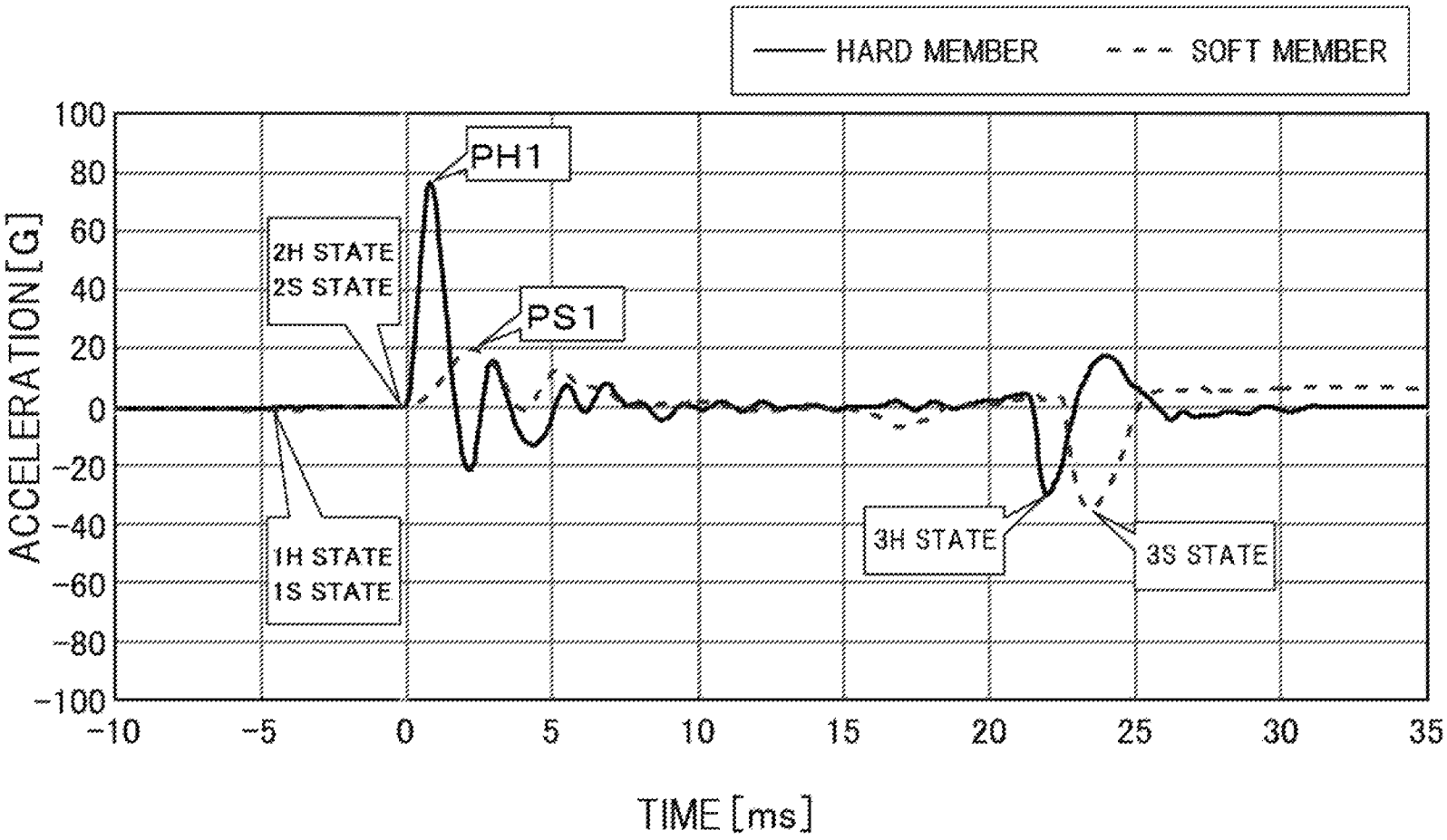
FIG. 8 is a graph representing a measurement value of an acceleration sensor attached in a contact part in a case where a downstroke speed of the nailing machine is the same.
Figure 9:
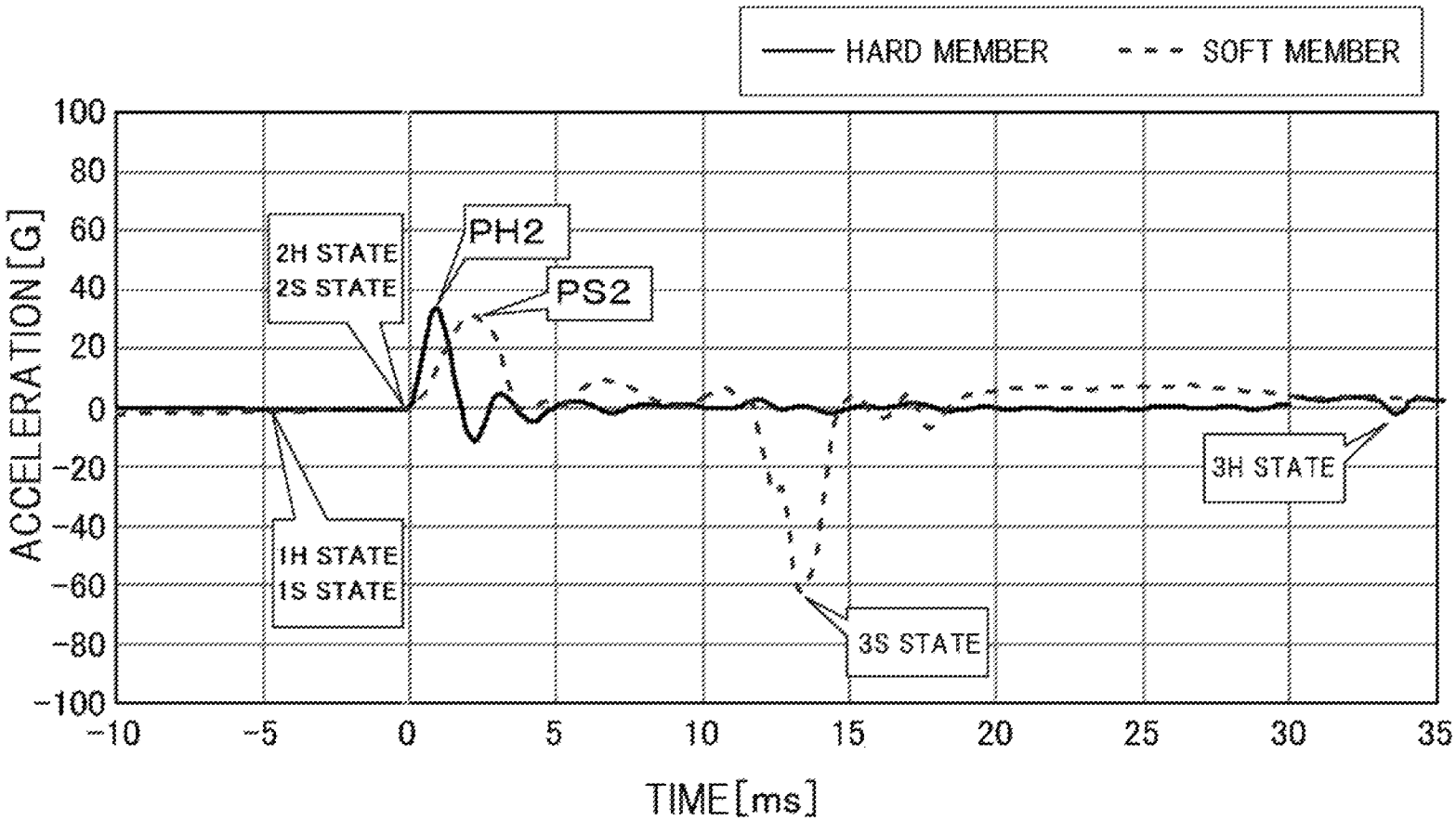
FIG. 9 is a graph representing a measurement value of the acceleration sensor attached in the contact part in a case where the downstroke speed of the nailing machine is different.

FIGS. 8 and 9 illustrate a measurement value measured by the acceleration sensor 18 attached in the contact part 7*a*, the axis of abscissas is set as time (msec), and the axis of ordinates is set as an acceleration (G: gravity acceleration=9.8 m/sec$^2$).

The axis of abscissas indicates elapsed time in which a moment when acceleration is generated in the contact part 7*a* with respect to the object is set as a starting point (0). A curve represented by a solid line is a graph indicating the change of the acceleration generated when the contact part 7*a* is brought into contact with the wood (W) as one example of a hard member, and a curve represented by a dash line is a graph indicating the change of the acceleration generated when the contact part 7*a* is brought into contact with the human (W') as one example of a soft member. The states 1H, 2H, and 3H illustrated in FIG. 8 correspond to the respective states of FIGS. 6A to 6C, and the states 1S, 2S, and 3S illustrated in FIG. 8 correspond to the respective states of FIGS. 7A to 7C.

FIG. 8 illustrates what effect the hardness and softness of the object have on the detected acceleration, and FIG. 9 illustrates what effect the difference (fastness and slowness) of a downstroke speed of the nailing machine 1 in a gravity direction has on the detected acceleration.

The measurement result illustrated in FIG. 8 represents a case where the nailing machine 1 is stroked down at the same speed with respect to both the hard object W and the soft object W' to bring the contact part 7*a* in contact therewith.

In a case where the downstroke speed is the same, it is understood that the acceleration generated in a short time immediately after the contacts (state 2H and state 2S) is obviously different between the case of contacting with the hard object W and the case of contacting with the soft object W'. In an example illustrated in the graph, in the case of the hard object W, a peak value PH1 of the momentary acceleration exceeds 70 G, while in the soft object W', a peak value PS1 of the momentary acceleration is about 20 G, which is less than one third of that in the former case. That is, it is represented that, in a case where the downstroke speed is the same, the impact acceleration received by the nailing machine 1 at the time of the contact becomes large depending on the hardness of the member.

In the case of contacting with the hard object W, the kinetic energy of the nailing machine 1 at the time of stroking down is converted to energy to vibrate the contact part and the object W. However, in the case of contacting with the soft object W', it is considered that a portion of the kinetic energy is used to deform the object so that the detected vibration decreases. Therefore, it is understood that the detected acceleration is varied depending on the hardness of the object.

The measurement result illustrated in FIG. 9 represents a case where the downstroke speed of the nailing machine 1 for bringing the contact part 7*a* in contact with the object is set to be different between the hard object W and the soft object W'. Specifically, in the hard object W, the speed of stroking down the nailing machine 1 is decreased, and in the soft object W', the contact with the contact part 7*a* is performed in the state of increasing the speed. FIG. 9 represents that there is a case where the downstroke speed is varied as above so that a peak value PH2 of the momentary acceleration in the case of the hard object W and a peak value PS2 of the momentary acceleration in the case of the soft object W' have the same value.

That is, a specific speed is not described, but the above example represents that the detected acceleration is varied according to the downstroke speed. Specifically, it is understood that when the downstroke speed increases, the momentary acceleration tends to become large, and when the downstroke speed decreases, the momentary acceleration tends to become small.

As above, the acceleration is varied according to the hardness of the object as described above, and, on the other hand, is also varied according to the downstroke speed. There is a certain relation between the hardness of the object and the downstroke speed.

Figure 10:
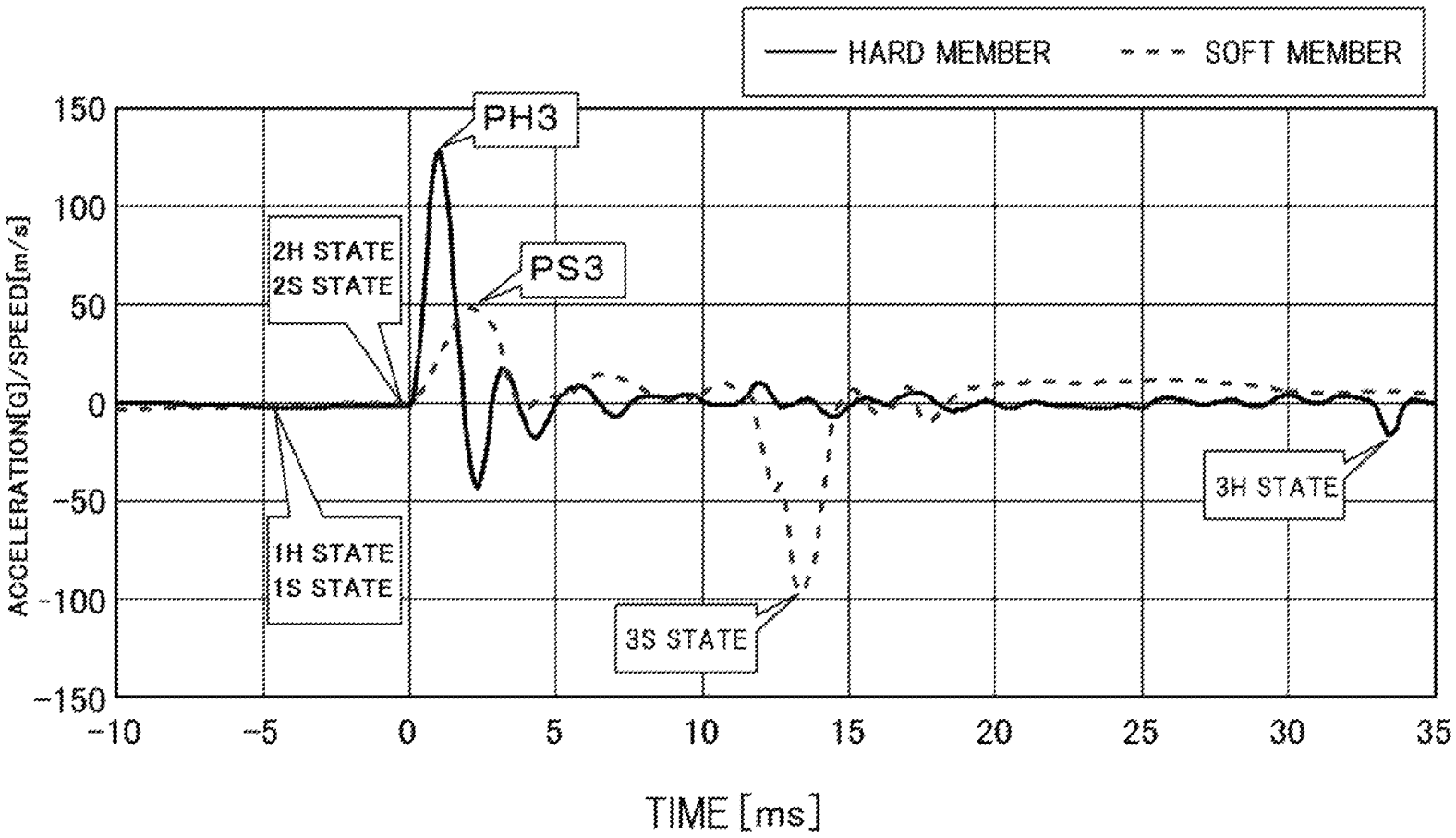
FIG. 10 is a graph representing a value obtained by dividing the measurement value measured by the acceleration sensor of the nailing machine by the downstroke speed.

FIG. 10 illustrates a value obtained by dividing the acceleration detected by the acceleration sensor 18 by the downstroke speed. That is, the axis of ordinates in FIG. 10 indicates a change rate of the acceleration to the speed.

The downstroke speed is the movement speed of the contact arm retreated by the contact with the driving target object. Thus, the downstroke speed is obtained based on the movement distance obtained from a displacement sensor 17 detecting the displacement of the contact arm and the time necessary to move (movement distance/time). The downstroke speed may be calculated from the change of the distance from the driving target object by using a non-contact sensor.

When viewing the graph of FIG. 10, comparing a peak value PH3 of the change rate of the acceleration of the contact part 7*a* contacting with the hard object W, and a peak value PH3 of the change rate of the acceleration of the contact part 7*a* contacting with the soft object W', the former value is more than twice the latter value.

As described above, it is understood from the data illustrated in FIGS. 8 and 9 that there is a relation in which when the downstroke speed increases, the acceleration also becomes large, and when the downstroke speed decreases, the acceleration also becomes small.

For this reason, when the values (normalized value) obtained by dividing the accelerations by the downstroke speeds at respective times are obtained, the change rate of the corresponding acceleration is a value in which an effect generated by the speed is reduced, and the hardness of the contacting member (object) is reflected. Therefore, the speed information at the time of the contact as well as the acceleration is used to improve the accuracy for distinguishing the hardness of the member.

The graph of FIG. 10 represents such a value. For example, based on the data obtained when the contact part 7*a* contacts the wood, such a control can be performed that in a case where the acceleration at the time of the contact is equal to or less than a half of the above basis, it is determined that the contact part 7*a* contacts a human or another object which are not the object, and thus the injection is limited.

The nailing machine 1 includes the controller 19 which computes the above-described information obtained by the acceleration sensor 18 and the displacement sensor 17. The controller 19 includes a computing unit such as CPU, a storage unit such as ROM and RAM storing a program, a control circuit, a power supply, and the like, and also includes a control function of a limiting unit which limits the injection of a nail.

In this embodiment, the closing valve 20 which is a solenoid valve is provided as the limiting unit which limits the injection of a nail. The closing valve 20 is disposed to open and close a pipe which connects the trigger valve 12 with the head valve 16, according to the control of the controller 19. When the closing valve 20 is closed, the output of the trigger valve 12 is not transmitted so that the operation of the head valve 16 is limited to limit the injection of a nail.

In this embodiment, the closing valve 20 is provided as an example of the limiting unit. However, as long as the injection of a nail can be limited despite of the control of the trigger lever 11, for example, the control of the trigger lever 11 becomes invalidated, another unit may be used without any problem.

As described above, in the fastener driving machine according to the disclosure, a behavior at the time of the contact which is obtained by the contact with the driving target object is measured by using the acceleration sensor, whereby it can be controlled whether the fastener driving is to be allowed or not.

The acceleration sensor is used to determine whether the driving target object is a target object or another object. However, as long as the same function is exhibited, a load cell, the displacement sensor, a strain sensor, a durometer may be used instead of the acceleration sensor without any problem. In the above-described fastener driving machine, the acceleration sensor as a unit for detecting the physical quantity is provided in the contact arm. However, a separate probe which contacts the driving target object may be provided to obtain the physical quantity associated with the contact with the driving target object from the probe.

The detection result of the physical quantity associated with the contact with the driving target object can be used to suppress the launch of a nail by invalidating the trigger control as described above.

The machine can be configured such that the injection of the fastener is allowed only in a predetermined time after the contact, and thus, if a practical contact is not preformed, the injection of the fastener is limited although the trigger lever is controlled. In this manner, an unintended use method can be limited in which, for example, the fastener driving machine is directed to air after the contact with the member, and the fastener is injected.

According to the detection result, it is possible to perform luminescence of color for allowing the luminescence or the launch through an alarm sound for suppressing the launch, a signal sound for allowing the launch, and the luminescent color for informing a danger.

As described above, the contact arm 7 has a motion stroke of 10 mm. When the contact arm includes a sensor which can specify a movement position like an encoder, a position where the tip of the contact arm is present in the motion stroke having the entire distance of 10 mm can be obtained as electronically processable information.

In the level of a resolution which means a fineness in which the entire distance is divided to be obtained as the position information, an optimal one at that time may be adapted based on the process speed of the information, the obtained effect, the efficiency, the price of the unit and the other conditions.

As an example of the resolution, the position of the contact arm can be obtained as specific positions (protruding amount of the tip of the contact part 7*a*) such as a start point (10 mm point) and a midpoint (5 mm point) of not contacting with the object W, and an end point (0 mm point) which is injectable. A process of 10 mm may be divided into ten parts so as to obtain positions by 1 mm, and may be more finely divided to obtain positions.

The displacement sensor 17 can obtain the practical movement distance as described above. When a time factor is added thereto, it is possible to more finely and quantitatively understand the behavior of the contact arm.

For example, in the above example, the time from the start point (10 mm point) to the midpoint (5 mm point) and the time from the midpoint (5 mm point) to the injectable end point (0 mm point) can be obtained. The change of the speed of the contact arm during the entire process can be understood quantitatively. The determination can be comprehensively performed by combining such information with the information obtained from the acceleration sensor (to be described later) separately provided. For example, compared with additional information obtained statistically, a process of limiting the injection can be performed in a dangerous use state.

As a sensor to be used, various kinds of detector such as an optical detector using reflected light or transmitted light of infrared ray, a detector using electrical contact, magnetic action, radio wave, and sound including ultrasonic wave, and a detector using the acceleration sensor may be used.

In the above example, the displacement sensor 17 is configured to detect the behavior of the contact arm, but a sensor may be provided in the housing 6 to detect the movement speed of the nailing machine 1 itself.

Second Embodiment

Figure 11:
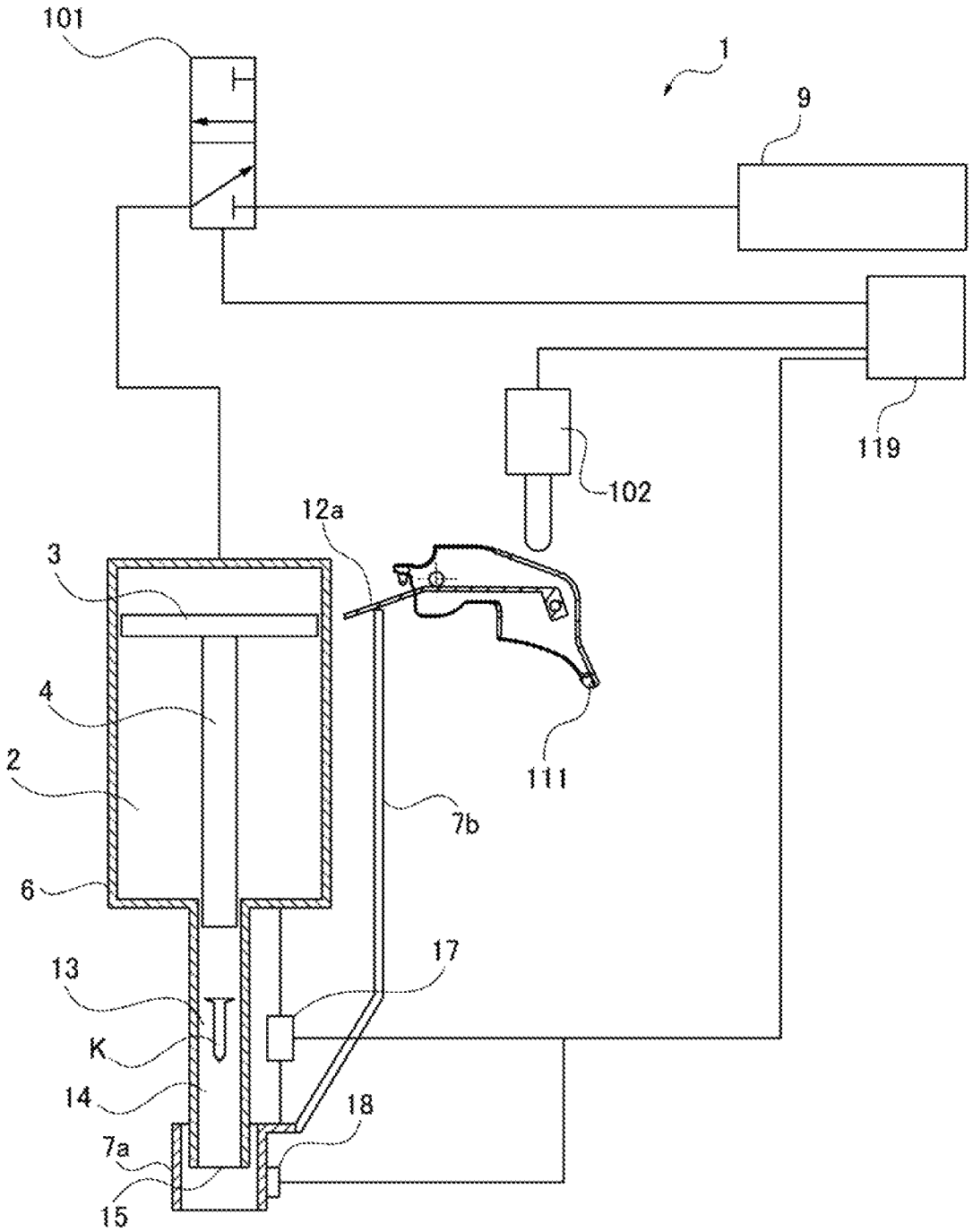
FIG. 11 is an explanatory diagram of an operating mechanism of a nailing machine according to a second embodiment.

Next, another example (nailing machine 100) of the nailing machine will be described with reference to FIG. 11.

The nailing machine 100 includes the cylinder 2 controlled by a head valve 101 and an actuator including the piston 3 (driver 4), and operates the driver 4 to inject the nail K based on the control of a trigger lever 111 having almost the same configuration as that of the above-described trigger lever 11. Similarly with the above-described example, the nailing machine 100 includes the contact arm 7 (7*a* and 7*b*) acting as a safety mechanism. The contact part 7*a* as the tip portion of the contact arm 7 is provided with the acceleration sensor 18 detecting the acceleration acting on the corresponding portion. The nailing machine 100 is provided with the displacement sensor 17 detecting the movement (displacement of position) as a behavior detector of the contact arm 7. Such a configuration is the same as that of the above-described nailing machine 1. The nailing machine 100 has the same configuration as that of the nailing machine 1 as another configuration. However, since the same configuration has been described above as the description of the nailing machine 1, the same reference numerals are applied thereto in the drawing, and the specific description is omitted.

In the nailing machine 100, a solenoid valve is used as the head valve 101 for operating the driver 4. The head valve 101 is not opened and closed by an operation pressure using air pressure, and is opened and closed by a solenoid moved by driving power from a controller 119.

The controller 119 requires almost the same configuration as that of the above-described controller 19, and has a configuration necessary to control each unit mounted on the nailing machine 100.

In the controller 119, the circuit is configured to receive a signal detected by the above-described displacement sensor 17 and acceleration sensor 18. The controller 119 includes a trigger switch 102 which has a conduction-type contact point for detecting the control of the trigger lever 111. The circuit is configured such that the detection signal from the trigger switch 102 is received by the controller 119. The trigger switch 102 may have a shape such as a microswitch and a reed switch, and any shape and method can be adopted as long as the control of the trigger lever 111 can be obtained as an electrical signal.

The nailing machine 100 processes the information from one or both of the displacement sensor 17 and the acceleration sensor 18, determines whether the nailing machine 100 contacts the intended driving target object or another one, and decides whether the control of the trigger lever 111 is valid or invalid. The control of the trigger lever 111 is transmitted to the controller 119 by the trigger switch 102. However, in a case where it is determined that the injection of the fastener is allowed, the controller 119 sends an operation signal to the head valve 101 to perform the injection motion by the driver 4. In a case where it is determined that the injection of the fastener is not allowed, it is checked that the control of the trigger lever 111 is invalid, and the injection motion by the driver 4 is not performed.

A general pneumatic and handheld-type nailing machine is mainly configured such that a mechanical configuration or a sequence circuit using the air pressure makes the control of the trigger lever valid or invalid based on the motion of the contact arm. This embodiment provides a new nailing machine which is a handheld nailing machine, and is configured such that the electrical control makes the control of the trigger lever valid or invalid.

Third Embodiment

Figure 12:
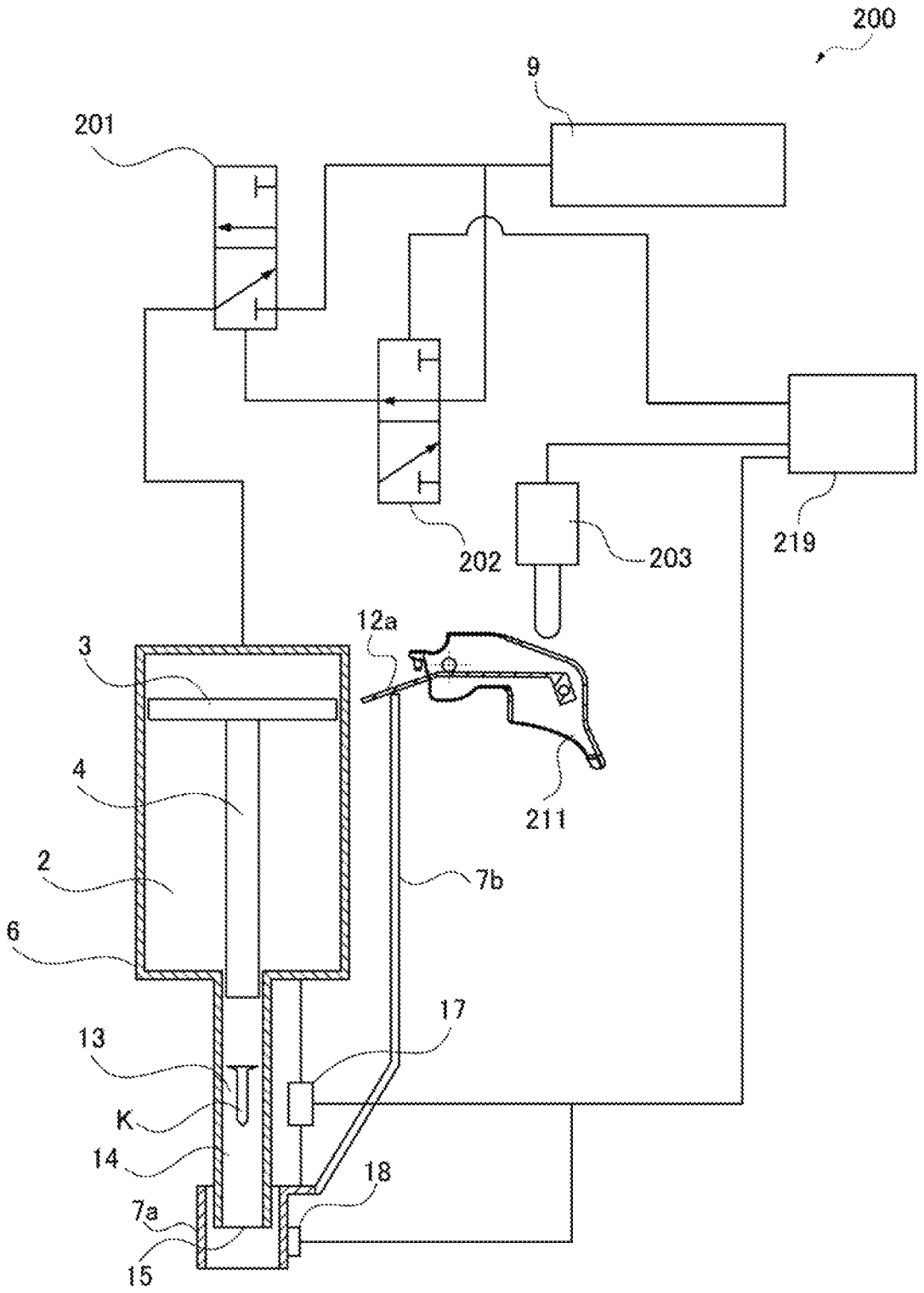
FIG. 12 is an explanatory diagram of an operating mechanism of a nailing machine according to a third embodiment.

Next, another example (nailing machine 200) of the nailing machine will be described with reference to FIG. 12.

The nailing machine 200 includes the cylinder 2 controlled by a head valve 201 and an actuator including the piston 3 (driver 4), and operates the driver 4 to inject the nail K based on the control of a trigger lever 211. The trigger lever 211 has almost the same configuration as that of the above-described trigger lever 11. Similarly with the above-described example, the nailing machine 200 includes the contact arm 7 acting as a safety mechanism. The contact part 7*a* as the tip portion of the contact arm 7 is provided with the acceleration sensor 18 detecting the acceleration acting on the corresponding portion. The nailing machine 200 is provided with the displacement sensor 17 detecting the movement (displacement of position) as a behavior detector of the contact arm 7. Such a configuration is the same as that of the above-described nailing machine 1. The nailing machine 200 has the same configuration as that of the nailing machine 1 as another configuration. However, since the same configuration has been described above as the description of the nailing machine 1, the same reference numerals are applied thereto in the drawing, and the specific description is omitted.

In the nailing machine 200, a valve for operating the compressed air as the operation pressure is used as the head valve 201 for operating the driver 4. The head valve 201 receives the operation pressure, which is output by a control valve 202 configured as the solenoid valve, to be moved.

A controller 219 requires almost the same configuration as that of the above-described controller 19, and has a configuration necessary to control each unit mounted on the nailing machine 200. In the controller 219, the circuit is configured to receive a signal detected by the above-described displacement sensor 17 and acceleration sensor 18. The controller 219 includes a trigger switch 203 which has a conduction-type contact point for detecting the control of the trigger lever 211. The circuit is configured to receive the detection signal from the trigger switch 203 by the controller 19. The trigger switch 203 may have a shape such as the microswitch and the reed switch, and any shape and method can be adopted as long as the control of the trigger lever 211 can be obtained as an electrical signal.

Similarly to the above-described nailing machine 1 and the nailing machine 100, the nailing machine 200 processes the information from one or both of the displacement sensor 17 and the acceleration sensor 18, determines whether the nailing machine 200 contacts the intended driving target object or another one, and decides whether the control of the trigger lever 211 is valid or invalid. The control of the trigger lever 211 is transmitted to the controller 219 by the trigger switch 203. However, in a case where it is determined that the injection of the fastener is allowed, the controller 219 controls the control valve 202 to output the operation pressure to the head valve 201 so that the head valve 201 is operated to perform the injection motion by the driver 4. In a case where it is determined that the injection of the fastener is not allowed, it is checked that the control of the trigger lever 211 is invalid, and the injection motion by the driver 4 is not performed.

Each of the above-described fastener driving machines according to the disclosure includes the contact arm contacting with the driving target object. In addition to the existing mechanical safety mechanism which validates the control in cooperation with the trigger lever, the vibration at the time of the contact, which is obtained by bring the contact arm as a contact member into contact with the driving target object, is measured by using the acceleration sensor, whereby it can be controlled whether the fastener driving is to be allowed or not.

The acceleration sensor is used to determine whether the driving target object is a target object or another object. However, as long as the same function is exhibited, another detector may be used without any problem. A piezoelectric element may be used instead of the acceleration sensor as a sensor detecting the vibration. The strain sensor, the load cell, the displacement sensor, and the durometer may be used as a sensor detecting deformation amount. The sound generated at the time of contact may be collected by a microphone and the like to be used for the determination.

In the above-described fastener driving machine, the acceleration sensor for detecting the acceleration as one kind of physical quantity is provided in the contact arm as a contact member. However, a separate member operating in conjunction with the contact arm may be provided to obtain the physical quantity associated with the contact with the driving target object. A separate probe which contacts the driving target object may be provided to obtain the physical quantity associated with the contact with the driving target object from the probe.

Fourth Embodiment

Figure 13:
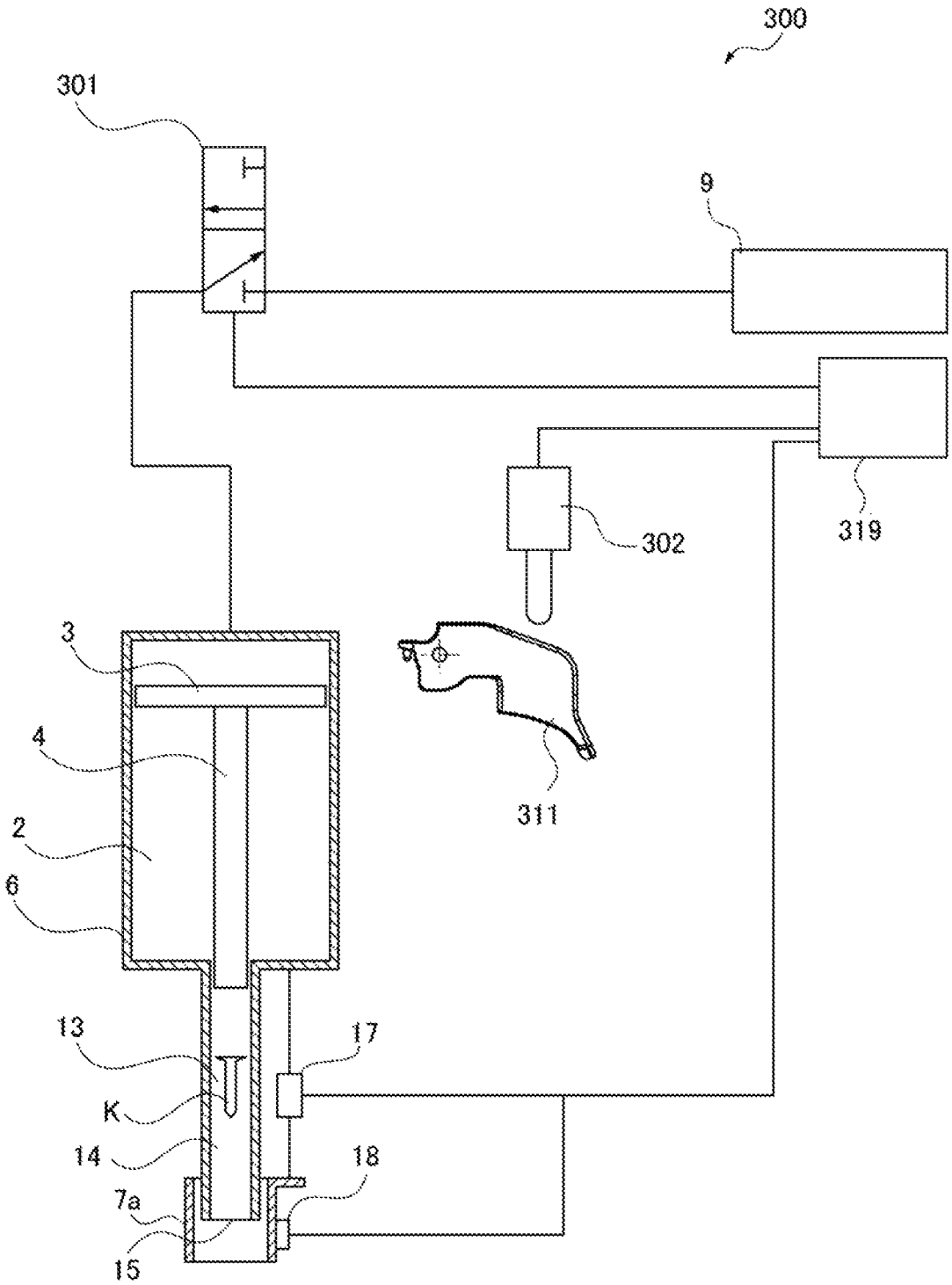
FIG. 13 is an explanatory diagram of an operating mechanism of a nailing machine according to a fourth embodiment.

Next, another example (nailing machine 300) of the nailing machine will be described with reference to FIG. 13.

The nailing machine 300 includes the cylinder 2 controlled by a head valve 301 and an actuator including the piston 3 (driver 4), and operates the driver 4 to inject the nail K based on the control of a trigger lever 311. The contact part 7*a* is provided with the acceleration sensor 18 detecting the acceleration acting on the corresponding part and the displacement sensor 17 detecting a movement (displacement of position) as a behavior detector of the contact part 7*a*. Unlike the above-described nailing machine according to each of the embodiments, the arm part being in cooperation with the trigger lever 311 is not provided, and a trigger switch 302 is configured to always detect the control of the trigger lever 311. The nailing machine 300 has the same configuration as that of the nailing machine 100 as another configuration. However, since the same configuration has been described above, the same reference numerals are applied thereto in the drawing, and the specific description is omitted.

The controller 319 requires almost the same configuration as that of the above-described controller 19, and has a configuration necessary to control each unit mounted on the nailing machine 300. In the controller 319, the circuit is configured to receive a signal detected by the above-described displacement sensor 17 and acceleration sensor 18. The trigger switch 302 has a conduction-type contact point for detecting the control of the trigger lever 311. The circuit is configured such that the detection signal from the trigger switch 302 is received by the controller 319.

Similarly to the above-described nailing machines, the nailing machine 300 processes the information from one or both of the displacement sensor 17 and the acceleration sensor 18, determines whether the nailing machine 300 contacts the intended driving target object or another one, and decides whether the control of the trigger lever 311 is valid or invalid. The control of the trigger lever 311 is transmitted to the controller 319 by the trigger switch 302. However, in a case where it is determined that the injection of the fastener is allowed, the controller 319 operates the head valve 301 to perform the injection motion by the driver 4.

The nailing machine 300 according to this embodiment includes a contact arm for contacting with the driving target object, and detects, based on the outputs of the displacement sensor 17 and the acceleration sensor 18, that the contact arm contacts the driving target object. Whether the controller 319 allows the fastener driving is determined based on the detection result, and the injection of the fastener is controlled by the operation of the head valve 301 based on the determination. For this reason, even when the mechanical safety mechanism is not provided, it is possible to control whether the fastener driving is allowed or not.

Fifth Embodiment

Figure 14:
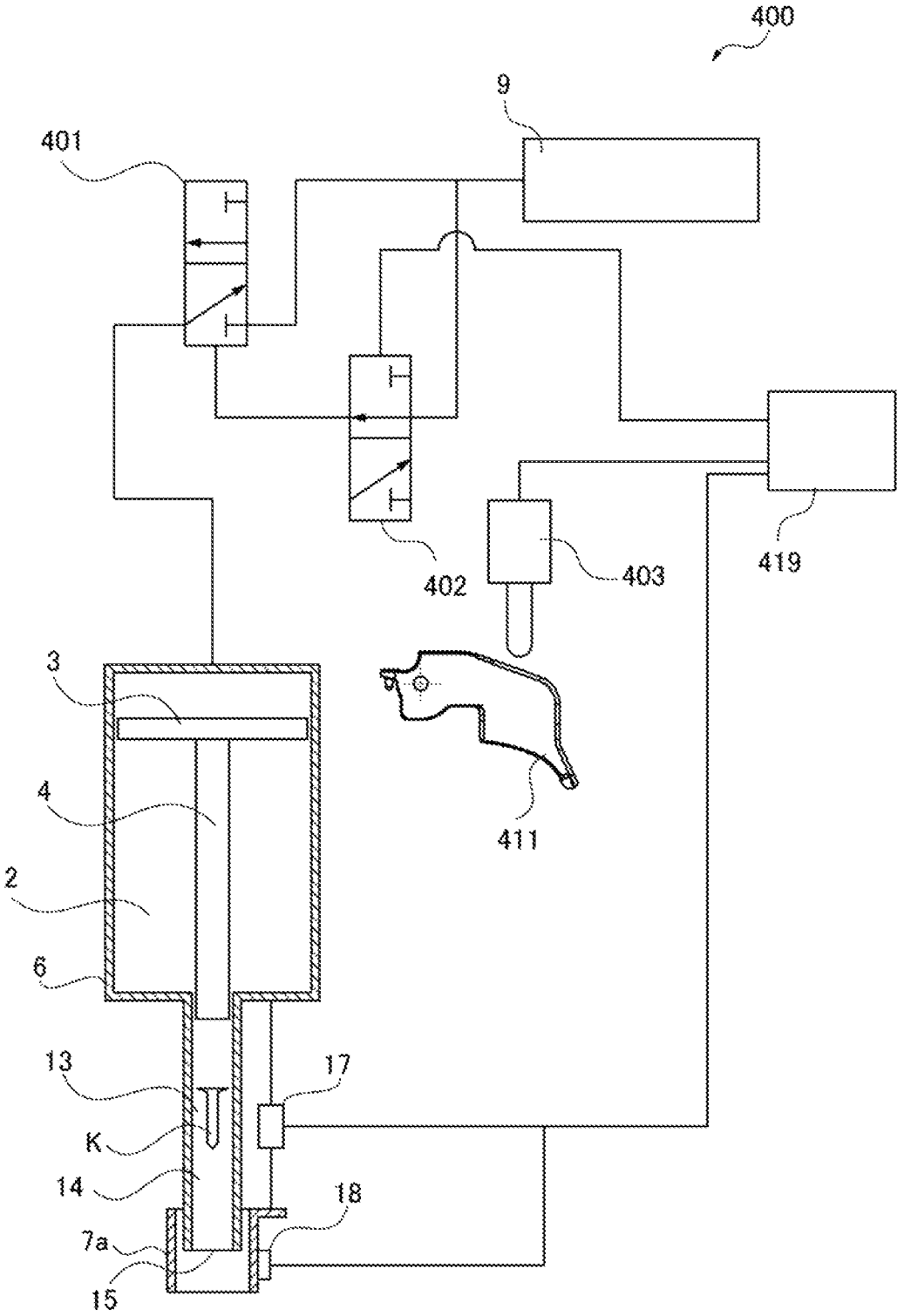
FIG. 14 is an explanatory diagram of an operating mechanism of a nailing machine according to a fifth embodiment.

Next, another example (nailing machine 400) of the nailing machine will be described with reference to FIG. 14.

The nailing machine 400 includes the cylinder 2 controlled by a head valve 401 and an actuator including the piston 3 (driver 4), and operates the driver 4 to inject the nail K based on the control of a trigger lever 411. The trigger lever 411 has almost the same configuration as that of the above-described trigger lever 311.

The contact part 7*a* is provided with the acceleration sensor 18 detecting the acceleration acting on the corresponding part and the displacement sensor 17 detecting a movement (displacement of position) as a behavior detector of the contact part 7*a*. However, the arm part being in cooperation with the trigger lever 411 is not provided, and a trigger switch 403 is configured to always detect the control of the trigger lever 411.

The nailing machine 400 has the same configuration as that of the nailing machine 400 as another configuration. However, since the same configuration has been described above, the same reference numerals are applied thereto in the drawing, and the specific description is omitted.

The controller 419 requires almost the same configuration as that of the above-described controller 19, and has a configuration necessary to control each unit mounted on the nailing machine 400. In the controller 419, the circuit is configured to receive a signal detected by the above-described displacement sensor 17 and acceleration sensor 18. The controller 419 includes a trigger switch 403 which has a conduction-type contact point for detecting the control of the trigger lever 411. The circuit is configured to receive the detection signal from the trigger switch 403 by the controller 419.

Similarly to the above-described nailing machines, the nailing machine 400 processes the information from one or both of the displacement sensor 17 and the acceleration sensor 18, determines whether the nailing machine 400 contacts the intended driving target object or another one, and decides whether the control of the trigger lever 411 is valid or invalid. The control of the trigger lever 411 is transmitted to the controller 419 by the trigger switch 403. However, in a case where it is determined that the injection of the fastener is allowed, the controller 419 controls the control valve 402 to output the operation pressure to the head valve 401 so that the head valve 401 is operated to perform the injection motion by the driver 4. In a case where it is determined that the injection of the fastener is not allowed, it is checked that the control of the trigger lever 411 is invalid, and the injection motion by the driver 4 is not performed.

The nailing machine 400 according to this embodiment includes a contact arm for contacting with the driving target object, and detects, based on the outputs of the displacement sensor 17 and the acceleration sensor 18, that the contact arm contacts the driving target object. Whether the controller 419 allows the fastener driving is determined based on the detection result, and the injection of the fastener is controlled by the operation of the head valve 401 based on the determination. For this reason, even when the mechanical safety mechanism is not provided, it is possible to control whether the fastener driving is allowed or not.

Sixth Embodiment

Figure 15:
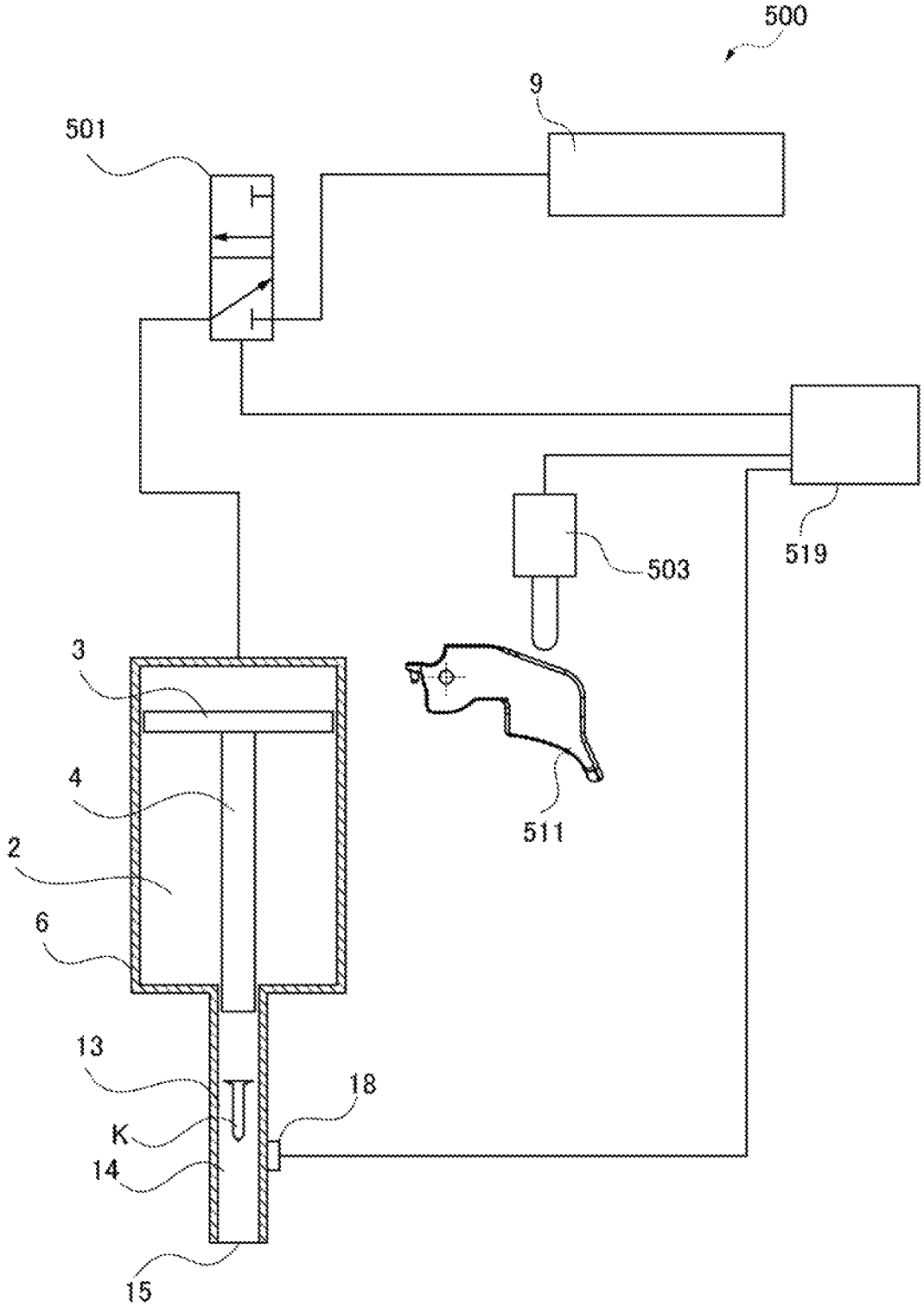
FIG. 15 is an explanatory diagram of an operating mechanism of a nailing machine according to a sixth embodiment.

Next, another example (nailing machine 500) of the nailing machine will be described with reference to FIG. 15.

The nailing machine 500 includes the cylinder 2 controlled by a head valve 501 and an actuator including the piston 3 (driver 4), and operates the driver 4 to inject the nail K based on the control of a trigger lever 511. The nailing machine 500 does not include the contact arm 7 provided with the above-described nailing machine. The acceleration sensor 18, which detects the acceleration or other physical quantity acting on the injection path according to the contact of the driving target object and the injection path, is provided. The nailing machine 500 has the same configuration as that of the above-described nailing machine as another configuration. However, since the same configuration has been described above, the same reference numerals are applied thereto in the drawing, and the specific description is omitted.

In the controller 519, the circuit is configured to receive a signal detected by the above-described acceleration sensor 18. The controller 519 includes a trigger switch 503 which has a conduction-type contact point for detecting the control of the trigger lever 511. The circuit is configured to receive the detection signal from the trigger switch 503 by the controller 519. The trigger switch 503 may have a shape such as the microswitch and the reed switch, and any shape and method can be adopted as long as the control of the trigger lever 511 can be obtained as an electrical signal.

The nailing machine 500 processes the information from the acceleration sensor 18, determines whether the nailing machine 500 contacts the intended driving target object or another one, and decides whether the control of the trigger lever 511 is valid or invalid. The control of the trigger lever 511 is transmitted to the controller 519 by the trigger switch 503. However, in a case where it is determined that the injection of the fastener is allowed, the controller 519 outputs the operation pressure to the head valve 501 so that the head valve 501 is operated to perform the injection motion by the driver 4. In a case where it is determined that the injection of the fastener is not allowed, it is checked that the control of the trigger lever 511 is invalid, and the injection motion by the driver 4 is not performed.

As long as it is possible to perform a proper detection, a body portion (handle grip 5, housing 6, and magazine 8) except the injection path may be provided with the acceleration sensor without any problem.

In this embodiment, without holding the contact arm, a fastener driving operation can be performed by the same control as that of the existing nailing machine with the contact arm, which does not affect usability. A new nailing machine which prevents an unintended fastener driving motion more reliably than the existing mechanical-type safety mechanism, and reduces (makes it unnecessary) a pressing load is provided to lessen the burden on the operator.

The detection result of the physical quantity associated with the contact with the driving target object can be used to suppress the launch of a nail by invalidating the trigger control as described above. According to the detection result, it is possible to perform luminescence of color by providing a notification unit for allowing the luminescence or the launch through an alarm sound for suppressing the launch, a signal sound for allowing the launch, and the luminescent color for informing a danger. According to the detection result, it is possible to control the output of the actuator. For example, in the case of the fastener driving machine in which the actuator is operated by using the air pressure, the output can be adjusted, for example, by limiting the opening of the valve or the time of releasing the valve. In a case where an electric motor is used as the actuator, the output can be adjusted by limiting current or voltage. In the fastener driving machine using a spring, the output can be adjusted by controlling the bending amount of the spring.

The hardness of the object is determined from the detection result, and the motion of the reaction absorption mechanism can be controlled according to the predicted reaction of the fastener driving.

The various kinds of above-described the embodiments may be practiced with various combinations thereof. The disclosure is not limited to the above-described embodiments, and various modifications can be made without departing from the scope of claims.

The disclosure can be used for various equipment and tools, and the like in which an adjustment of operation force of a device or an allowance and limit of an operation is performed based on physical information obtained by practical contact with an object. Particularly, it is proper to be used for a nailing machine.

The invention claimed is:

1. A fastener driving machine comprising:

an actuator which injects a fastener to a driving target object;

a controller;

a vibration sensor which detects a value of a vibration generated when the fastener driving machine contacts the driving target object; and a speed detector which detects a movement speed of the fastener driving machine when the fastener driving machine contacts the driving target object, wherein the controller limits an operation of the actuator based on the value of the vibration detected by the vibration sensor and the movement speed detected by the speed detector, wherein the fastener driving machine comprises a contact member configured to be movable according to the contact with the driving target object, and wherein the speed detector detects the movement speed based on a movement of the contact member.

2. The fastener driving machine according to claim 1, wherein the vibration sensor is provided in the contact member or a member interlinked with the contact member.

3. The fastener driving machine according to claim 1, wherein the controller decides an operation force of the actuator based on the vibration detected by the vibration sensor which detects vibration changed by a contact with the driving target object.

4. The fastener driving machine according to claim 1, wherein the controller obtains a divided value by dividing the value of the vibration from the vibration sensor by the movement speed from the speed detector, and the controller operates the actuator when a peak of the divided value exceeds a predetermined value.

5. A fastener driving machine comprising:

an actuator which injects a fastener to a driving target object;

a controller;

a vibration sensor which detects a value of a vibration generated when the fastener driving machine contacts the driving target object; and a speed detector which detects a movement speed of the fastener driving machine when the fastener driving machine contacts the driving target object, wherein the controller limits an operation of the actuator based on the value of the vibration detected by the vibration sensor and the movement speed detected by the speed detector, and wherein the controller obtains a divided value by dividing the value of the vibration detected by the vibration sensor by the movement speed detected by the speed detector, and the controller controls the actuator based on the divided value.

6. The fastener driving machine according to claim 5, wherein the controller operates the actuator when a peak of the divided value exceeds a predetermined value and prevents operation of the actuator when the peak is below the predetermined value.

* * * * *